US006529225B1

(12) United States Patent
Shiraiwa et al.

(10) Patent No.: US 6,529,225 B1
(45) Date of Patent: Mar. 4, 2003

(54) PRINTING METHOD AND APPARATUS

(75) Inventors: Yoshinobu Shiraiwa, Tokyo (JP); Hiroshi Kyogoku, Kanagawa (JP); Takashi Sasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 09/746,164

(22) Filed: Dec. 26, 2000

(30) Foreign Application Priority Data

Dec. 27, 1999 (JP) ..... 11-371531

(51) Int. Cl.[7] ..... B41J 2/325
(52) U.S. Cl. ..... 347/212
(58) Field of Search ..... 347/212, 171, 347/172, 174, 176; 400/120.18, 120.01, 120.02, 120.04

(56) References Cited

U.S. PATENT DOCUMENTS 5,555,011 A * 9/1996 Tang et al. ..... 347/212

6,130,698 A * 10/2000 Katsuda et al. ..... 347/212

* cited by examiner

*Primary Examiner*—Huan Tran
(74) *Attorney, Agent, or Firm*—Fitzpatrick, Cella, Harper & Scinto

(57) ABSTRACT

There are disclosed a printing method and apparatus which can prevent an overcoat layer formed on the surface of a printing medium for the purpose of protecting a printed image from being torn off or peeling from the printing medium so that an overcoat agent will not become a contaminant and stain a print in the printing apparatus, cause image print abnormality, or become fine or powder dust in the environment. This apparatus prints an image on a printing medium having perforations that allow easy cutoff of margin portions by applying ink to the printing medium across the perforations, and forms a protection layer on the printing medium on which the image has been formed by transferring a protection agent avoiding the perforation portions.

21 Claims, 8 Drawing Sheets

PRINTING METHOD AND APPARATUS

FIELD OF THE INVENTION

This invention relates to a printing method and apparatus for printing by applying ink to a printing medium and, more particularly, to a printing method and apparatus for printing an image by transferring ink applied on an ink sheet to a printing medium.

BACKGROUND OF THE INVENTION

Nowadays, as digital video cameras, digital cameras, and the like have become more prevalent, demand for color printers that print color images obtained by these apparatuses is increasing. One of printing methods of such color printers is a method of forming an ink image on a print sheet by selectively heating an ink sheet or ink ribbon applied with a thermal sublimation or hot-melt ink and applying (transferring) ink onto a printing medium.

Especially, a sublimation type thermal transfer printing apparatus can obtain high-quality full-color images, and is considered promising as a color printer for a digital camera.

As is known, an image printed using hot-melt ink is vulnerable to scratches. On the other hand, an image printed using thermal sublimation ink is easily deteriorated due to a fingerprint containing fats and oils, a plasticizer, and the like, and suffers color deterioration due to ultraviolet rays and re-sublimation due to heat. Hence, in order to protect a printed image, a so-called overcoat technique is known. In this technique, an overcoat layer is provided to an ink ribbon together with a color ink layer used to form an image, and after an ink image is transferred onto a printing sheet to form an image, the overcoat agent of the overcoat layer is transferred onto the printing sheet to form a protect layer on the image.

With this technique, an image obtained by the thermal transfer printing apparatus is environmentally and chemically tolerant, and is imparted with gloss, thus obtaining a high-quality, full-color image equivalent to a silver halide photo (photograph).

In the thermal transfer printing apparatus, since a printing sheet is reciprocally moved relative to a thermal head to print a plurality of color images, the printing sheet must be held upon printing images. Since margin portions where no image can be printed are formed on the printing sheet due to such mechanical limitation, an image cannot be printed on the entire surface of the printing sheet unlike a silver halide photo. However, some large-scale, business-use thermal transfer printing apparatuses use a printing sheet roll, and incorporate a cutter so as to realize the entire surface printing of a printing sheet. However, since such apparatus uses a sheet roll and incorporates a cutter, it is bulky and expensive.

In order to easily print an image on the entire surface of a printing sheet using a compact, inexpensive apparatus, a printing sheet having perforations as cut-off portions which are formed on the two sides of the printing sheet in the conveyance direction and allow the user to easily cut off margin portions is used, and an image is printed slightly larger than the finally required printing sheet size in which the margin portions are cut off at the perforations. After an image is printed, the margin portions are removed at the perforations to obtain a printed image which is printed on the entire surface of the printing sheet like a silver halide photo.

Using the overcoat technique and the printing technique on the entire surface of a printing sheet using perforations, even a compact, inexpensive thermal transfer printing apparatus can easily obtain a printed image, which is printed on the entire surface of the printing sheet like a silver halide photo, is environmentally and chemically tolerant and has a glossy appearance.

At this time, an image is normally printed slightly larger than the finally required printing sheet size in which margin portions are removed at perforations, taking print positioning accuracy in the printing apparatus into consideration, so that the printed image on the entire surface of a printing sheet can be consequently obtained. Also, an overcoat agent is applied to cover the entire printed image to form a protect layer that can sufficiently protect the printed image. Also, color ink transfer and overcoating of the overcoat agent onto a printing sheet are attained by the same method. In general, these processes are executed in the same sequence. As a result, the overcoat agent is also attached to the region of the printing sheet where the perforations are formed.

In this way, using the overcoat technique and the printing technique on the entire surface of a printing sheet using perforations, even a compact, inexpensive thermal transfer printing apparatus can easily obtain a printed image, which is printed on the entire surface of the printing sheet like a silver halide photo, is environmentally and chemically tolerant and has a glossy appearance.

However, in the prior art, in order to stably transfer an overcoat agent layer, optimal thermal transfer energy must be applied upon transfer, and a good bonding state between the printing sheet and overcoat layer must be obtained.

The perforations formed on the printing sheet are microscopically a plurality of holes (pores) forming a dotted line on the printing sheet, and portions around the holes that form the perforations on the surface of a printing sheet are roughened by the perforation forming process. Hence, the overcoat agent applied near the perforations of a printing sheet might not be stably transferred, and might readily peel since the agent is not satisfactorily transferred.

FIG. 8 is a sectional view and partial enlarged view of a print obtained by printing an image on a printing sheet in accordance with a conventional printing method. Referring to FIG. 8, reference numeral 21 denotes an overcoat layer formed by transferring an overcoat agent; and 22, perforations formed on the printing sheet.

Normally, an image printing region is covered by an overcoat region. In FIG. 8, the cross-hatched region corresponds to the image printing region, and the region where the overcoat agent is applied. Since a thin overcoat agent layer is formed to close the holes of the perforations, as shown in FIG. 8, this portion might be torn or cut off by a slight touch. Since the margin portions have to be cut off at the perforations to finally obtain a desired print, the overcoat layer formed around the perforations is torn off or peels anyway. In this manner, the overcoat layer formed around the perforations cannot be stably attached to the printing sheet, and is normally torn off or peels.

The overcoat layer (agent) that has been torn off or peeled becomes fine dust or powder dust, and is released into the environment where the printing apparatus is set. Such dust becomes contaminants for the printing apparatus, and may stain a print or cause image printing abnormality. Also, such fine or powder dust may pollute the environment where the apparatus is set.

SUMMARY OF THE INVENTION

Accordingly, it is an object of the present invention to provide a printing method and apparatus which can prevent an overcoat agent applied onto the surface of a printing medium for the purpose of protecting a printed image from being torn off or peeling from the printing medium, so that the overcoat agent will not become contaminants for the printing apparatus to stain a print, cause image printing abnormality, and become fine or powder dust in an environment.

According to one aspect of the present invention, the foregoing object is attained by providing a printing method for printing an image on a printing medium having cut-off portions that allow easy cutoff, comprising a printing step of printing an image by applying ink on the printing medium including the cut-off portions, and a protection layer forming step of forming a protection layer on the printing medium by applying a protection agent to a region, on the printing medium on which the image has been formed, except at least for the cut-off portions.

The printing step preferably includes the step of transferring and printing the image by frame-sequentially applying different color inks (e.g., yellow, magenta, and cyan inks) onto the printing medium using a thermal transfer printing method that uses an ink sheet applied with ink and prints by transferring the ink by heat energy.

According to another aspect of the present invention, the foregoing object is attained by providing a printing apparatus which uses a printhead for printing an image on a printing medium and prints an image on a printing medium having cut-off portions that allow easy cutoff, comprising printing means for printing an image by applying ink on the printing medium including the cut-off portions using the printhead, and protection layer forming means for forming a protection layer on the printing medium by applying a protection agent to a region, on the printing medium on which the image has been formed, except for the cut-off portions.

The printhead is preferably a thermal head having a linear array of a plurality of heating elements, and the ink and the protection agent are preferably applied on a sheet. Therefore, the printing means preferably heats the sheet using the thermal head and transfers the ink applied on the sheet to the printing medium, while the protection layer forming means preferably heats the sheet using the thermal head, and transfers the protection agent applied on the sheet to the printing medium.

Furthermore, the apparatus preferably further comprises conveyance means for conveying the printing medium, and the printing medium is preferably a printing paper sheet, which is formed with the cut-off portions at two end portions along a conveyance direction by the convey means.

When such printing sheet is used, the protection layer forming means can transfer the protection agent to avoid margins of the cut-off portions formed on the two end portions of the printing paper sheet, or can transfer the protection agent to a region of the printing paper sheet bounded by the cut-off portions while avoiding margins of the cut-off portions formed on the two end portions of the printing paper sheet.

Upon transferring the protection agent while conveying the printing medium by the conveyance means, a heat amount generated by the heating elements of the thermal head may gradually increase at the beginning of transfer of the protection agent, and may gradually decrease at the end of transfer of the protection agent.

In accordance with the present invention as described above, an image is printed on a printing medium, having cut-off portions that allow the user to easily cut off margin portions, by applying ink on a region including the cut-off portions on the printing medium, and a protection agent is applied to a region, except for the cut-off portion on the printing medium on which the image has been printed, to form a protection layer on the printing medium.

The invention is particularly advantageous when the margin portions are cut off from the printing medium at the cut-off portions, the protection layer formed on the printing medium can be prevented from peeling from the printing medium due to the cut-off portions, and a high-quality printed image can be stably preserved for a long period of time.

Since neither fine dust nor powder dust are produced due to the peeled protection layer, stain of a print, operation abnormality of the printing apparatus, and pollution of an environment where the apparatus is set owing to such dust can be prevented.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Figure 1:
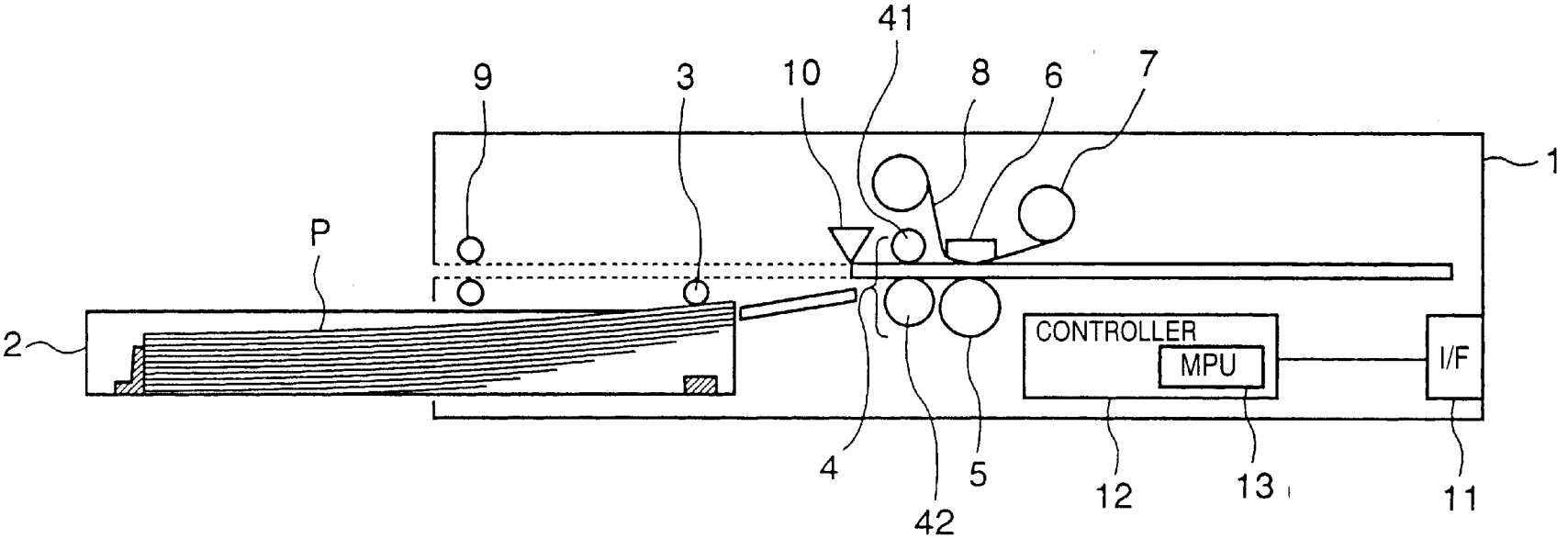
FIG. 1 is a side sectional view depicting the structure of a thermal transfer printing apparatus as a typical embodiment of the present invention.

FIG. 1 is a side sectional view depicting the structure of a thermal transfer printing apparatus (to be referred to as a printing apparatus hereinafter) as a typical embodiment of the present invention. The overall structure of the printing apparatus will be explained first. Printing sheets P stacked in a paper cassette 2 are picked up and fed one by one to an apparatus main body 1 by a pickup roller 3. A printing sheet P is clamped and conveyed by a pair of conveyance rollers 4, so that the printing sheet P can be reciprocally moved relative to a printing unit.

In the printing unit, a platen roller 5 and thermal head 6 that generates heat in accordance with information to be printed oppose each other to sandwich a printing sheet conveyance path therebetween. The thermal head 6 presses an ink sheet 8, which is stored in an ink cassette 7 and has an ink layer applied with hot-melt or thermal sublimation ink, and an overcoat layer used to form an overcoat on the printing surface to protect the printing surface, against the printing sheet P, and selectively heats the ink sheet 8, thus transferring a predetermined image onto the printing sheet P, and forming a protection layer that overcoats the printing sheet P.

The ink sheet 8 is prepared by juxtaposing yellow (Y), magenta (M), and cyan (C) ink layers and an overcoat (OP) layer each having a size approximately equal to that of the printing region of the printing sheet P to cover the printing region. Every time color ink for each layer is thermally transferred, the printing sheet P is returned to a print start position (P1), thus transferring the respective color inks on the printing sheet to overlap each other.

In this way, the printing sheet P is reciprocally moved in correspondence with the total number of color ink and overcoat layers, and is finally guided to a pair of exhaust rollers 9 and is exhausted outside the apparatus housing, thus ending the printing operation.

Figure 2:
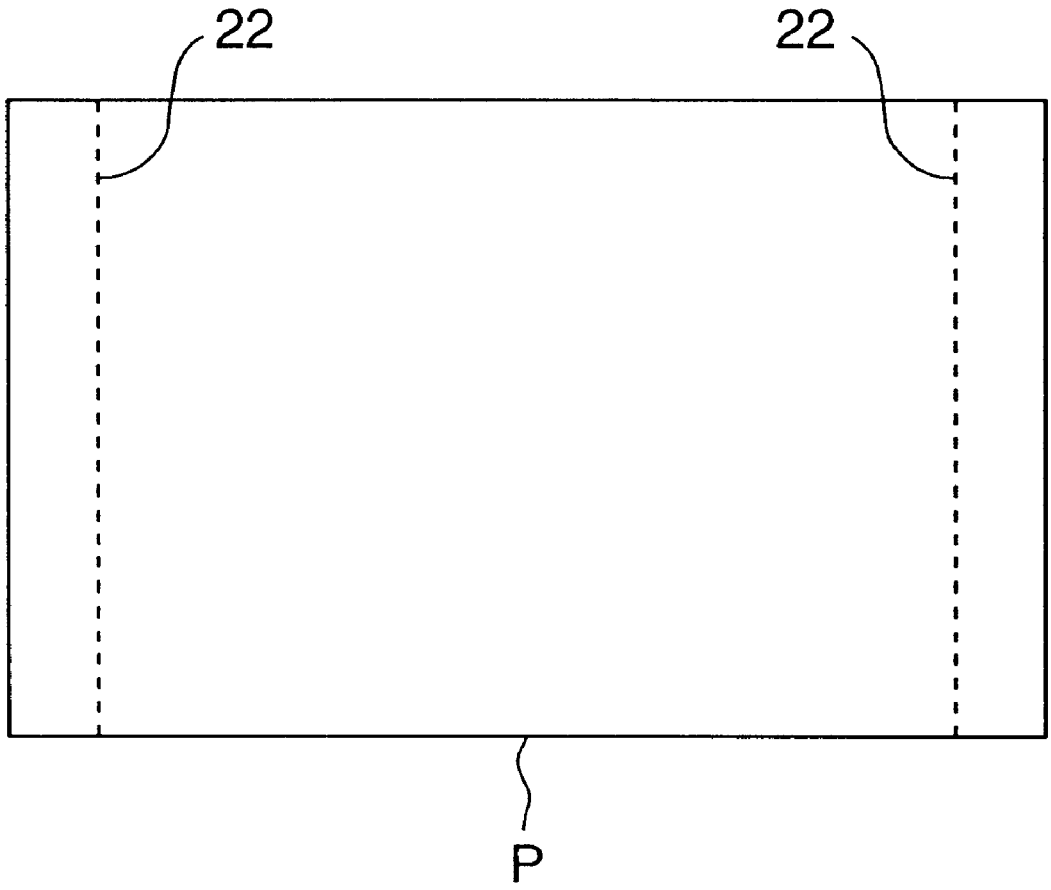
FIG. 2 is a view showing a printing sheet with perforations.

Since the normal thermal transfer printing apparatus frame-sequentially prints three colors Y, M, and C, control for accurately matching the printing leading ends of the respective colors is required. For this reason, the pair of conveyance rollers 4 must securely clamp and convey the printing sheet P without releasing it. As a result, unprintable margin portions must be required on the edge portions of the printing sheet P. In order to finally obtain a print without any extra-margins, as shown in FIG. 2, the printing sheet P has perforations 22 formed by dotted-line pattern holes as cut-off portions that allow the user to easily manually cut off margin portions where no image can be printed since they are securely clamped by the pair of conveyance rollers 4 at the beginning of the print process.

In this embodiment, an image is printed using such printing sheet P with perforations and the thermal transfer printing apparatus, and no overcoat agent is applied to the regions of the cut-off portions formed on the printing sheet P upon printing.

The pair of conveyance rollers 4 include a pinch roller 42 and grip roller 41, and the rotating shaft of a stepping motor (not shown) is directly coupled to the grip roller 41 via a reduction gear mechanism to freely drive the grip roller 41 in the forward/reverse direction under the rotation control of the stepping motor. Since the printing sheet P is securely clamped and reciprocally conveyed by the pair of conveyance rollers 4, it is conveyed while undergoing accurate position control by means of the rotation control of the stepping motor. If the printing pitch per line by the thermal head 6 is 85 $\mu$m, and the number of steps of the stepping motor required for conveying the printing sheet P by one line is 4, the printing sheet P can be conveyed by one line (i.e., 85 $\mu$m) by controlling rotation of the stepping motor to be four steps.

Furthermore, the printing apparatus 1 has a printing sheet leading end sensor 10 at a position immediately before the pair of conveyance rollers 4 when they are viewed from the pickup roller 3. With this sensor, when a printing sheet P is fed from the paper cassette 2 or is conveyed toward the exhaust rollers 9, the leading end (or trailing end) of the printing sheet P is detected, and after detection the printing sheet P is fed by the predetermined number of lines and is stopped within the range that the pair of conveyance rollers 4 can clamp it. In this embodiment, convey of the printing sheet is stopped after the stepping motor has rotated for 10 lines, i.e., for 40 steps. This position corresponds to the aforementioned print start position (P1).

Such operation for stopping conveyance of the printing sheet at the print start position (P1) is made a total of four times upon transferring the Y, M, and C color inks and overcoat layer.

Note that the distance between the printing sheet leading end sensor 10 and the position where the printing sheet P is pressed by the platen roller 5 and thermal head 6 is set at 10 mm in this embodiment in consideration of the parts layout in the apparatus.

When the printing sheet P stops at the print start position (P1), it is conveyed toward the exhaust rollers 9, the printing sheet leading end sensor 10 detects the leading end of the printing sheet again, the printing sheet is fed by the predetermined number of lines, and the thermal head is driven to generate heat in correspondence with information to be printed, thus printing predetermined images of the respective color inks and transferring the overcoat layer.

On the other hand, a device such as a digital still camera, digital video camera, or the like is directly connected to the printing apparatus of this embodiment via a predetermined connection cable, and data of images captured by such device are input to the apparatus via an interface (I/F) 11, and the apparatus can print an image on a printing sheet on the basis of such image data. For this purpose, the printing apparatus comprises a controller 12 that incorporates an MPU 13 for executing printing control. When the MPU 13 reads out and executes codes stored in the internal ROM of the controller 12, a predetermined image process and image print process are implemented.

Figure 3:
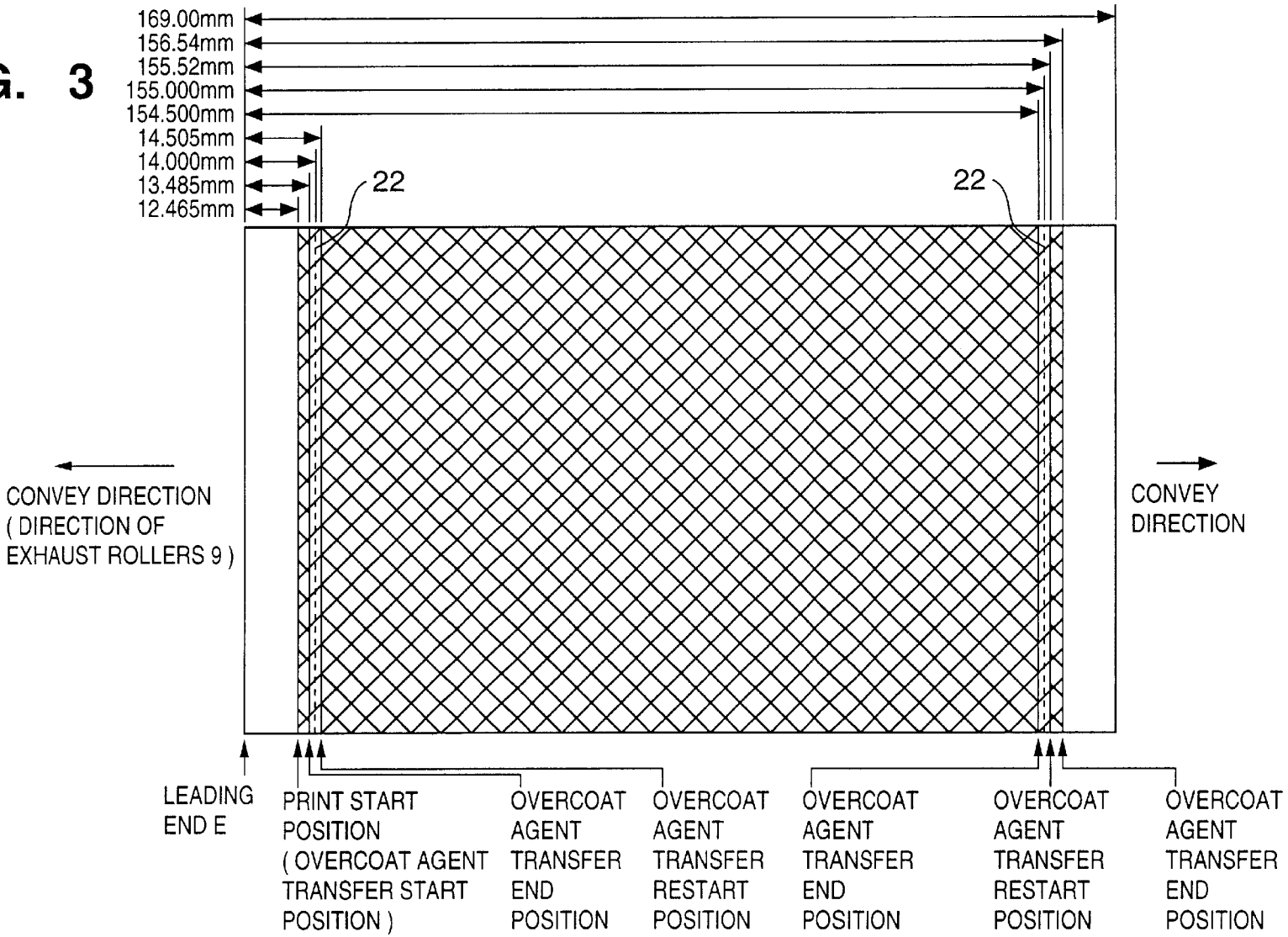
FIG. 3 is a view showing the image printing position and overcoat position together with the dimensions of the printing sheet.

FIG. 3 shows the image printing position and overcoat position together with the dimensions of a printing sheet. In FIG. 3, hatched regions undergo only an image print process, and also correspond to perforation regions. On the other hand, cross-hatched regions undergo both an image print process and overcoating.

Since the image printing range shown in FIG. 3 is around 144 mm wide in the conveyance direction, 1,694 lines can be printed, and the stepping motor can be rotated for 6,776 steps to convey the printing sheet by those lines.

The printing method using the printing apparatus with the aforementioned arrangement will be explained in detail below.

A conventional method will be explained first for the purpose of comparison.

Figure 4:
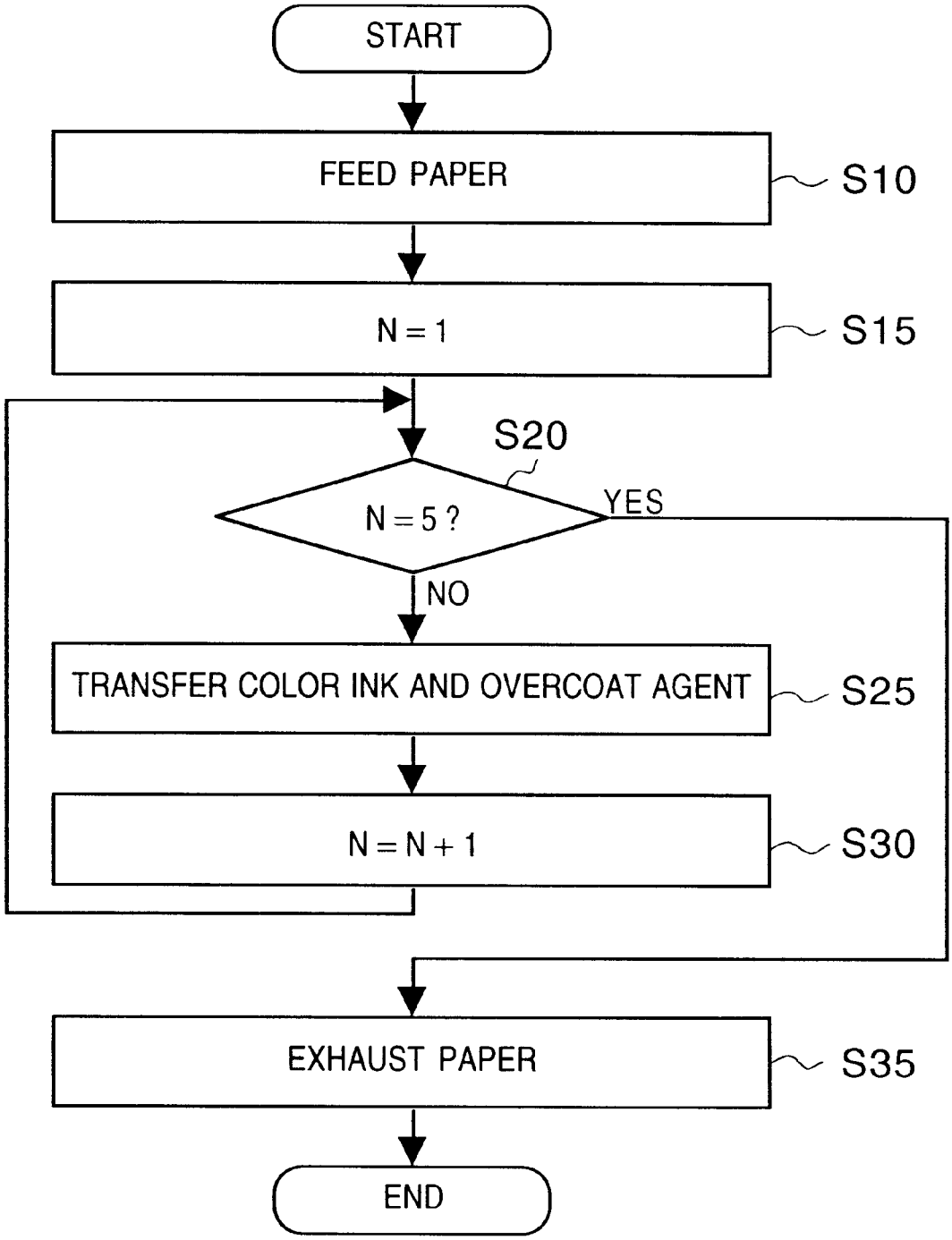
FIG. 4 ( PRIOR ART )
FIG. 4 is a flow chart showing a conventional printing method.

FIG. 4 is a flow chart showing the conventional printing method.

A printing sheet P is fed from the paper cassette 2 in step S10, and an initial value (N=1) is set in a control parameter variable (N) in step S15.

The value of the control parameter variable (N) is checked in step S20. If N=5, it is determined that ink transfer and overcoat layer transfer are complete, and the flow jumps to step S35 to exhaust the printing sheet P, then ending the processing. On the other hand, if N≠5, the flow advances to step S25.

In step S25, the Y, M, and C inks and overcoat agent are frame-sequentially transferred. Upon completion of transfer of one of the Y, M, and C inks and overcoat agent, the flow advances to step S30 to increment the value of the control parameter variable (N) by "+1". After that, the flow returns to step S20.

As described above, according to the conventional method, the transfer print processes of the respective color inks and the overcoat layer transfer process are executed in the same processing sequence.

Figure 5:
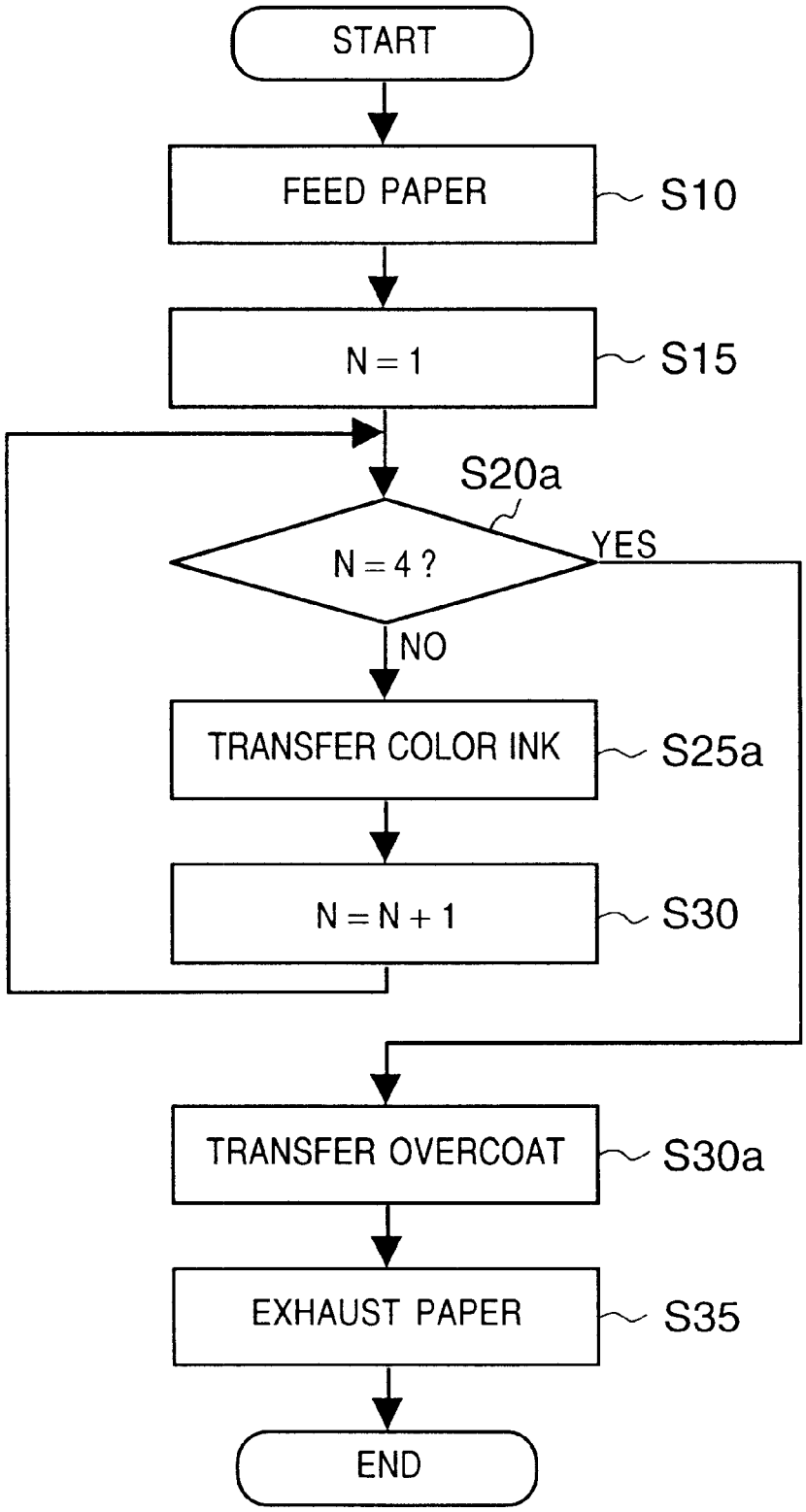
FIG. 5 is a flow chart showing a printing method in which a color ink transfer process and an overcoat agent transfer process are executed in different processing steps.

By contrast, in the printing method according to this embodiment, as shown in the flow chart in FIG. 5, color ink transfer processes and an overcoat agent transfer process are executed in different processing steps. Note that the same step numbers in the flow chart in FIG. 5 denote the same processes as those in the flow chart in FIG. 4, and a detailed description thereof will be omitted.

After the processes in steps S10 and S15, the value of the control parameter variable (N) is checked in step S20*a*. If N=4, the flow jumps to step S30*a;* if N≠4, the flow advances to step S25*a*.

In step S25*a,* the respective color inks are transferred onto the printing sheet, and details of the process are as follows:

(1) After the leading end of the printing sheet P is detected, the stepping motor 116 is rotated for 116 steps to start a print process. The print start position at that time is 12.465 mm from the leading end (E) of the printing sheet.

(2) While rotating the stepping motor for four steps, the thermal head is driven to generate heat, thus printing an image for one line. This print process comes to an end after the stepping motor has rotated for a total of 6,776 steps (1,694 lines). The print end position at that time is 156.455 mm from the leading end (E) of the printing sheet.

(3) The stepping motor is rotated for about 10 lines (40 steps) for the purpose of deceleration until conveyance of the printing sheet is stopped, thus stopping conveyance of the printing sheet.

(4) The stepping motor is driven in the reverse direction from that state to convey the printing sheet P in a direction opposite to that upon printing. After the printing sheet leading end sensor 10 detects the leading end of the printing sheet again, the stepping motor is rotated for about 10 lines (40 steps) for the purpose of deceleration. After that, conveyance of the printing sheet is stopped.

(5) In order to print an image using another color ink, the stepping motor rotates again to convey the printing sheet P.

In step S30, the control parameter variable (N) is incremented by "+1", and the flow returns to step S20*a*.

After such process is repeated three times, the print processes for three colors Y, M, and C are complete, and a desired image is transferred and printed on the printing sheet P1. At this time, since the control parameter variable (N) becomes N=4, the flow advances to step S30*a*.

In step S30*a,* the overcoat layer is transferred to protect the surface of the printed image. Details of the overcoat layer transfer process will be explained below.

(1) After the leading end of the printing sheet P is detected, the stepping motor 116 is rotated for 116 steps to start transfer of the overcoat agent. At this time, the coating start position is 12.465 mm from the leading end (E) of the printing sheet as that upon printing.

(2) While rotating the stepping motor for four steps, the thermal head is driven to generate heat, thus transferring an overcoat agent for one line. The stepping motor is rotated for a total of 48 steps (12 lines), thus ending transfer of the overcoat agent. The head position at that time is 13.485 mm from the leading end (E) of the printing sheet.

(3) The stepping motor is rotated for 48 steps (12 lines) without driving the thermal head. The head position at that time is 14.505 mm from the leading end (E) of the printing sheet.

(4) The thermal head is driven again to generate heat to transfer an overcoat agent for one line while rotating the stepping motor for four steps, and this process proceeds over a total of 6,588 steps (1,647 lines) until transfer of the overcoat agent is complete. The head position upon completion of transfer is 154.5 mm from the leading end (E) of the printing sheet.

(5) The stepping motor is rotated for 48 steps (12 lines) without driving the thermal head, thus conveying the printing sheet. The head position at that time is 155.52 mm away from the leading end (E) of the printing sheet.

(6) The thermal head is driven again to generate heat, and the overcoat agent is transferred for one line while rotating the stepping motor for four steps. The stepping motor is rotated for a total of 48 steps (12 lines), thus ending transfer of the overcoat agent. The head position at that time is 156.54 mm from the leading end (E) of the printing sheet.

(7) The stepping motor is rotated for about 10 lines (40 steps) for the purpose of deceleration until conveyance of the printing sheet is stopped, thus stopping conveyance of the printing sheet.

In this manner, the transfer print process of the respective color inks and overcoat agent are complete.

Finally, the flow advances to step S35, and the printing sheet P is guided to the pair of exhaust rollers 9 and is discharged outside the housing, thus ending the print process.

Therefore, according to the aforementioned embodiment, since the overcoat agent is transferred so as not to form any overcoat layer on portions of the printing sheet where perforations as cut-off portions are present, even when the margin portions of the printing sheets are cut off along the perforations after the print process, the overcoat layer can be prevented from peeling, and a high-quality printed image can be stably preserved for a long period of time. Since the overcoat layer never peels, neither fine dust nor powder dust are produced due to peeling of the overcoat layer, thus preventing environmental pollution and any causes of failures of the printing apparatus.

In the above description, regions where no overcoat layer is formed have been explained as predetermined regions including the perforations as cut-off portions. For the purpose of protecting an image, the predetermined regions are preferably as small as possible, and can be set within the range in which the overcoat layer can be prevented from peeling.

As described above, the present invention is characterized in that when an image is formed on a printing medium having cut-off portions that allow the user to easily cut off margin portions, a region on the printing medium where ink is applied during a print process, and a region on the printing medium where a protection agent is applied during a process for forming a protection layer by applying the protection agent are appropriately set to be different from each other, and no protection agent is applied to the cut-off portions on the printing medium. Hence, upon cutting off margin portions from the printing medium along the cut-off portions, the protection agent is prevented from peeling, so that no dust or powder dust can be scattered.

[Another Embodiment]

In the above embodiment, as shown in FIG. 3, the overcoat agent is transferred onto the nearly entire image printing region except for perforation regions for the purpose of protection of a print. In general, portions cut off along the perforations are removed and discarded. Hence, no overcoat layer need be formed on such portions which are to be discarded.

Figure 6:
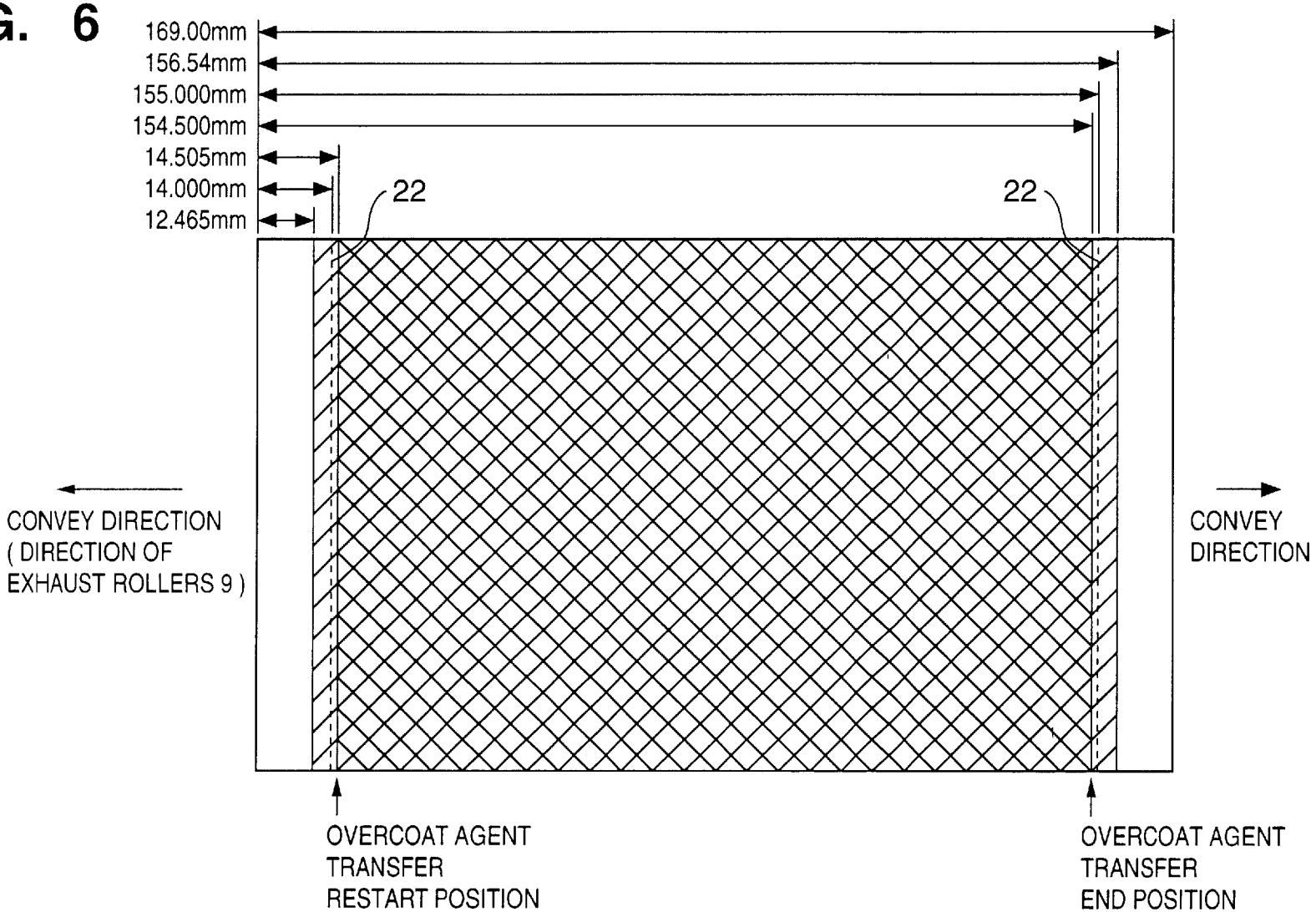
FIG. 6 is a view showing a print on which an overcoat agent is applied to only a region bounded by the perforations.

This embodiment is made in consideration of such situation, and a print shown in FIG. 6 is obtained. That is, an overcoat agent is transferred onto only a region bounded by perforations formed at the two sides of the printing sheet in the conveyance direction, thus obtaining an overcoated print. In FIG. 6, hatched regions undergo only an image print process, and a cross-hatched region undergoes both the image print process and overcoat agent transfer process.

Operations for obtaining such print will be explained in detail below.

A printing sheet and thermal transfer printing apparatus used in this embodiment are common to those in the aforementioned embodiment.

A characteristic feature of this embodiment lies in the overcoat agent transfer process in step S30*a* shown in FIG. 5. This process is performed as follows.

(1) The overcoat agent begins to be transferred by rotating the stepping motor 212 steps after detection of the leading end (E) of the printing sheet. The transfer start position at that time is 14.505 mm from the leading end (E) of the printing sheet.

(2) While rotating the stepping motor for four steps, the thermal head is driven to generate heat, thus transferring an overcoat agent for one line. This process proceeds over 6,588 steps (1,647 lines) of the stepping motor until transfer of the overcoat agent comes to an end. The head position at that time is 154.5 mm from the leading end (E) of the printing sheet.

(3) The stepping motor is rotated for about 10 lines (40 steps) for the purpose of deceleration until conveyance of the printing sheet is stopped, thus stopping conveyance of the printing sheet.

In this manner, transfer of the overcoat agent is complete.

According to the aforementioned embodiment, since the overcoat layer is formed on only a region slightly inside the perforations, the overcoat agent can be prevented from being wasted.

Figure 7:
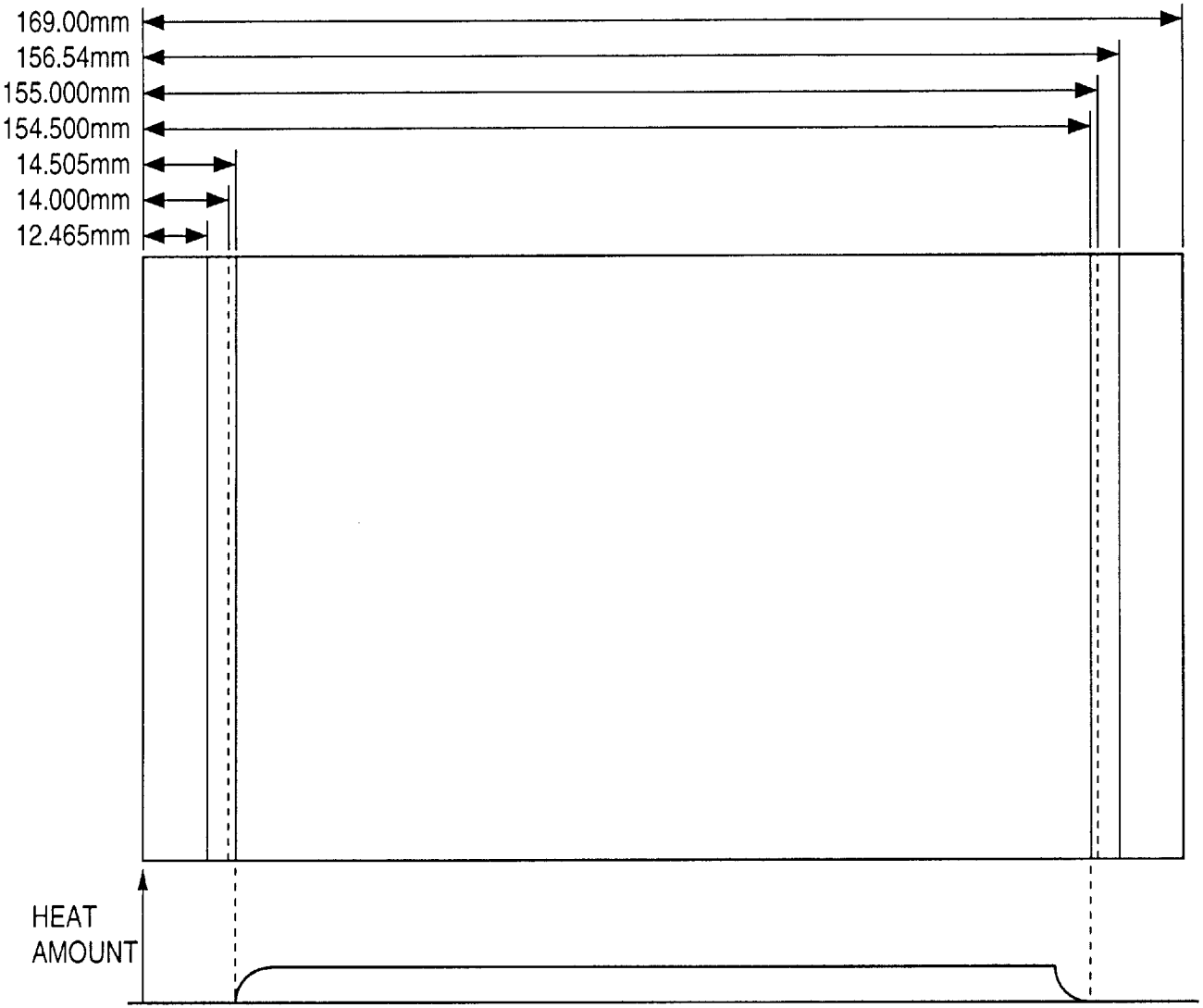
FIG. 7 is a view showing a process for changing the heat amount from a thermal head in the conveyance direction of the printing sheet upon transferring the overcoat agent.
Figure 8:
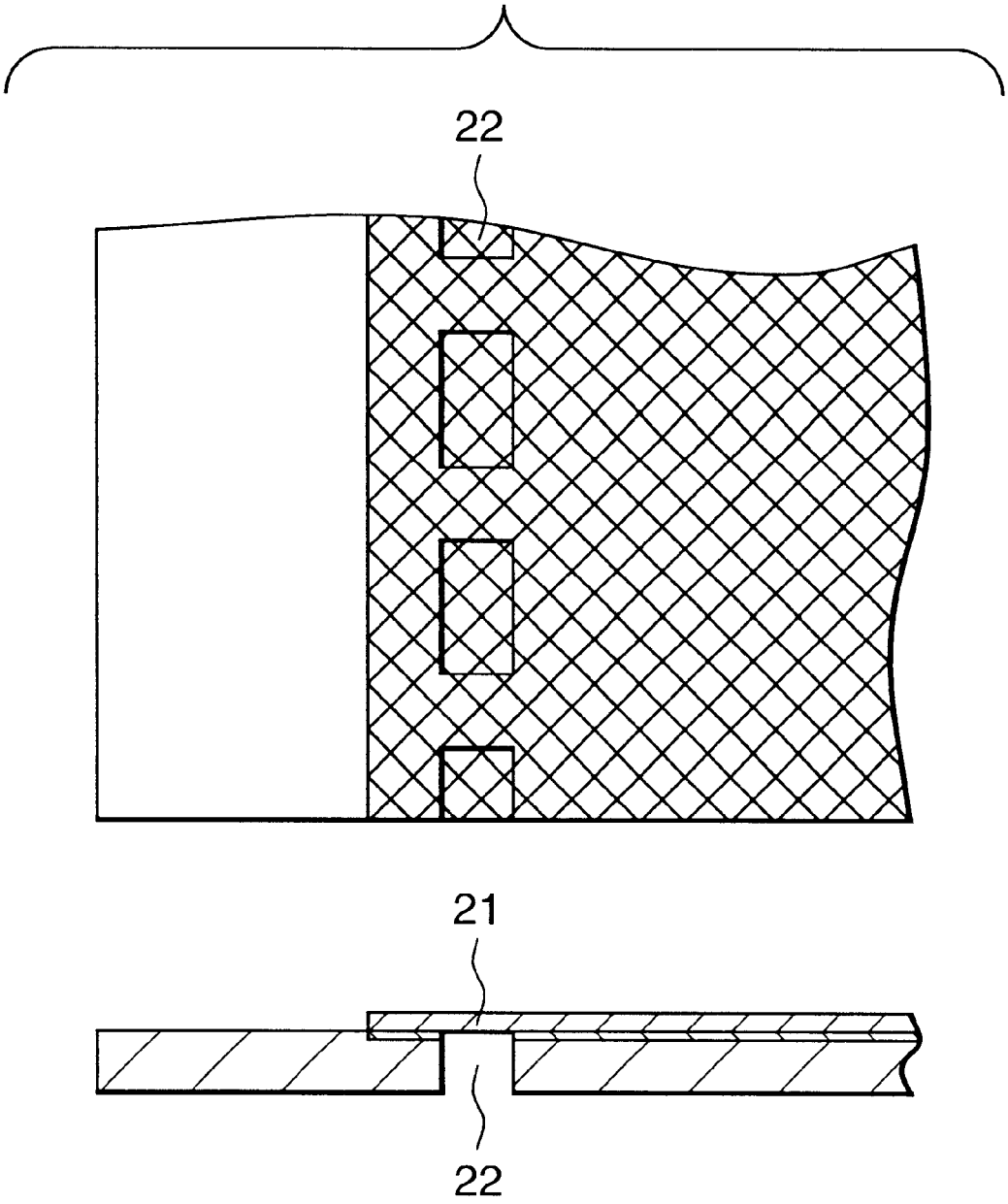
FIG. 8 ( PRIOR ART )
FIG. 8 is a sectional view and partial enlarged view of a print obtained by printing an image on a printing sheet in accordance with the conventional printing method.

In the aforementioned embodiments, the overcoat agent is transferred by only turning on/off the heat generation driving of the thermal head. In order to transfer the overcoat layer more stably, the heat amount may be controlled to gradually increase at the beginning of transfer of the overcoat agent, and to gradually decrease at the end of transfer of the overcoat agent, as shown in FIG. 7.

In the above embodiments, heat generation driving of the thermal head is stopped to stop transfer of the overcoat agent. However, the present invention is not limited to such specific arrangement. For example, the thermal head clamps and presses the ink sheet and printing sheet in the transfer print process, and transfer of the overcoat layer may be stopped by releasing the pressing operation.

In the aforementioned embodiments, in the transfer print process of the Y, M, and C color inks and overcoat agent, the print position management is made by detecting the leading end of the printing sheet by the printing sheet leading end sensor and managing the number of steps of rotation driving of the stepping motor with reference to the leading end detection signal. However, the present invention is not limited to such specific arrangement. For example, the print position management may be made by managing the number of steps of rotation driving of the stepping motor throughout the print operation on the basis of the number of steps of the stepping motor and the positional relationship upon conveying the printing sheet P using the leading end detection signal of the printing sheet initially detected by the printing sheet leading end sensor when feeding the printing sheet P.

Note that the present invention is characterized in that no overcoat layer is formed on perforation regions formed on the printing sheet so as to easily obtain a print without any extra-margins. Since the transfer print process at a desired position on the printing sheet is determined by the specifications of the thermal head and the arrangement of the conveyance means as described in the above embodiments, and can be achieved by managing them using predetermined means, modifications of the present invention can be applied to printing sheets with various sizes and perforation positions.

Furthermore, in the aforementioned embodiments, the thermal transfer printing apparatus has been exemplified. However, the present invention is not limited to such a specific apparatus, and a printing apparatus using other printing methods such as an ink-jet printing apparatus may be used as long as they print using printing media such as printing sheets with perforations.

Note that the present invention may be applied to either a system constituted by a plurality of devices (e.g., a host computer, an interface device, a reader, a printer, and the like), or an apparatus consisting of a single piece of equipment (e.g., a copying machine, a facsimile apparatus, or the like).

The objects of the present invention are also achieved by supplying a storage medium (or recording medium), which stores a program code of a software program that can implement the functions of the above-mentioned embodiments to the system or apparatus, and reading out and executing the program code stored in the storage medium by a computer (or a CPU or MPU) of the system or apparatus. In this case, the program code itself read out from the storage medium implements the functions of the above-mentioned embodiments, and the storage medium which stores the program code constitutes the present invention. The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension card or a function extension unit, which is inserted in or connected to the computer, after the program code read out from the storage medium is written in a memory of the extension card or unit.

In the above embodiments, the perforations formed by dot-line pattern holes have been exemplified as cut-off portions that allow the user to easily cut off margin portions from a printing medium. However, the present invention is not limited to the printing medium with perforations, but can be applied to a printing medium in which the thickness of a portion to be cut off is set to be smaller than the remaining portion, and a printing medium in which cut-off portions are formed of a material that allows easy cutting.

As many apparently widely different embodiments of the present invention can be made without departing from the spirit and scope thereof, it is to be understood that the invention is not limited to the specific embodiments thereof except as defined in the appended claims.

What is claimed is:

1. A printing method for printing an image on a printing medium having cut-off portions that allow easy cutoff, comprising:

a printing step of printing an image by applying ink on the printing medium including the cut-off portions; and a protection layer forming step of forming a protection layer on the printing medium by applying a protection agent to a region on the printing medium on which the image has been formed, except for at least to the cut-off portions.

2. The method according to claim 1, wherein said printing step includes a step of forming the image by frame-sequentially transferring different color inks onto the printing medium.

3. The method according to claim 2, wherein said printing step includes a step of printing in accordance with a thermal transfer printing method that uses an ink sheet applied with ink and prints by transferring the ink by heat energy.

4. The method according to claim 2, wherein the different colors include yellow, magenta, and cyan inks.

5. The method according to claim 1, wherein the cut-off portions are portions where holes like a dotted line are formed on the printing medium, and said protection layer forming step includes a step of forming the protection layer so as not to apply the protection agent to predetermined regions including the holes like a dotted line.

6. The method according to claim 1, wherein the cut-off portions are perforations.

7. A printing apparatus which uses a printhead for printing an image on a printing medium and prints an image on a printing medium having cut-off portions that allow easy cutoff, comprising:

printing means for printing an image by applying ink on the printing medium including the cut-off portions using the printhead; and protection layer forming means for forming a protection layer on the printing medium by applying a protection agent to a region, on the printing medium on which the image has been formed, except for at least the cut-off portions.

8. The apparatus according to claim 7, wherein the printhead is a thermal head having a linear array of a plurality of heating elements.

9. The apparatus according to claim 8, wherein the ink and the protection agent are applied on a sheet.

10. The apparatus according to claim 9, wherein said printing means heats the sheet using the thermal head and transfers the ink applied on the sheet to the printing medium.

11. The apparatus according to claim 9, wherein said protection layer forming means heats the sheet using the thermal head, and transfers the protection agent applied on the sheet to the printing medium.

12. The apparatus according to claim 8, further comprising conveyance means for conveying the printing medium.

13. The apparatus according to claim 12, wherein the printing medium is a printing paper sheet, which is formed with the cut-off portions at two end portions along a conveyance direction in which the printing paper sheet is conveyed by said conveyance means.

14. The apparatus according to claim 13, wherein said protection layer forming means transfers the protection agent to avoid margins of the cut-off portions formed on the two end portions of the printing paper sheet.

15. The apparatus according to claim 13, wherein said protection layer forming means transfers the protection agent to a region of the printing paper sheet bounded by the cut-off portions while avoiding margins of the cut-off portions formed on the two end portions of the printing paper sheet.

16. The apparatus according to claim 12, wherein upon transferring the protection agent while conveying the printing medium by said conveyance means, a heat amount generated by the heating elements of the thermal head gradually increases at the beginning of transfer of the protection agent, and gradually decreases at the end of transfer of the protection agent.

17. The apparatus according to claim 7, wherein the cut-off portions are portions obtained by forming holes like a dotted line on the printing medium.

18. The apparatus according to claim 17, wherein said protection layer forming means forms the protection layer so as not to apply the protection agent to predetermined regions including the holes like a dotted line.

19. The apparatus according to claim 17, wherein the cut-off portions are perforations.

20. A printing method for printing by applying ink and a protection agent onto a printing medium using a printhead, comprising:

a printing step of printing an image by applying the ink onto the printing medium; and a protection layer forming step of forming a protection layer on the printing medium by applying the protection agent onto the printing medium, wherein upon printing an image on the printing medium having cut-off portions that allow easy cutoff, a region on the printing medium onto which the ink is applied in said printing step is different from a region on the printing medium onto which the protection agent is applied in said protection layer forming step.

21. A printing apparatus for printing by applying ink and a protection agent onto a printing medium using a printhead, comprising:

printing means for printing an image by applying the ink onto the printing medium using the printhead; and protection layer forming means for forming a protection layer on the printing medium by applying the protection agent onto the printing medium using the printhead, wherein upon forming the protection layer on the printing medium having cut-off portions that allow easy cutoff, said protection layer forming means sets a region onto which the protection agent is applied to be different from a region on which the image is formed by said printing means.

* * * * *